US009795938B2

(12) United States Patent
Abo-Hammour

(10) Patent No.: US 9,795,938 B2
(45) Date of Patent: Oct. 24, 2017

(54) METHOD AND APPARATUS FOR INDIRECT MAGNETIC TREATMENT OF FLUIDS AND GASES

(75) Inventor: Zaer Abo-Hammour, Amman (JO)

(73) Assignee: PROFESSIONALS FOR ENERGY—ENVIRONMENT AND WATER SOLUTIONS LTD. CO., Amman (JO)

( * ) Notice: Subject to any disclaimer, the term of this patent is extended or adjusted under 35 U.S.C. 154(b) by 608 days.

(21) Appl. No.: 14/118,709

(22) PCT Filed: May 16, 2012

(86) PCT No.: PCT/EP2012/059164
§ 371 (c)(1),
(2), (4) Date: Nov. 19, 2013

(87) PCT Pub. No.: WO2012/156464
PCT Pub. Date: Nov. 22, 2012

(65) Prior Publication Data

US 2014/0104977 A1 Apr. 17, 2014

(30) Foreign Application Priority Data

May 16, 2012 (CA) ..... 2740584

(51) Int. Cl.
*B01F 13/08* (2006.01)
*C10G 15/08* (2006.01)
(Continued)

(52) U.S. Cl.
CPC ..... *B01F 13/0809* (2013.01); *C10G 15/08* (2013.01); *C10G 32/02* (2013.01); *C10G 33/02* (2013.01)

(58) Field of Classification Search
CPC ..... B01F 13/0809
See application file for complete search history.

(56) References Cited

U.S. PATENT DOCUMENTS 3,236,503 A * 2/1966 Fukushima ..... B01F 13/0809 366/191
4,025,355 A * 5/1977 Mozhaev ..... B01F 3/1235 106/403

(Continued)

FOREIGN PATENT DOCUMENTS

EP 0 200 710 A2 12/1986
EP 1 970 109 A1 9/2008

(Continued)

*Primary Examiner* — Abbas Rashid
(74) *Attorney, Agent, or Firm* — Sughrue Mion, PLLC

(57) ABSTRACT

There is provided a method and apparatus for indirect magnetic treatment of fluids/gases, where a magnetic or electromagnetic field having a certain dimension, geometry and flux density is, in a first step, applied to a working fluid/gas to obtain the directly magnetized fluid/gas. Then the directly magnetized fluid/gas is used in a second step as a magnetizer or a magnetic treating agent for magnetizing indirectly the normal non-magnetized fluid/gas by mixing the directly magnetized fluid/gas and normal non-magnetized fluid/gas in accordance with a predetermined mixing ratio and mixing method between the directly magnetized fluid/gas and normal non-magnetized working fluid/gas. Afterwards, the resultant mixed or indirectly-magnetized fluid/gas is used in the proper application directly or stored in a storage tank for later use. Possible applications for the invention include, but not limited to, all previous applications of the direct magnetic treatment of fluid/gas such as water treatment, hydrocarbon fuel treatment.

10 Claims, 19 Drawing Sheets an exemplary production process of the directly magnetized or treated fluid/gas using inline pre-treatment and post-treatment sensors configuration.

(51) Int. Cl.
*C10G 32/02* (2006.01)
*C10G 33/02* (2006.01)

(56) References Cited

U.S. PATENT DOCUMENTS

| | | | | | |
|---|---|---|---|---|---|
| 4,093,189 | A * | 6/1978 | Sokol | B01F 13/0809 | 366/156.1 |
| 4,320,003 | A | 3/1982 | Sanderson et al. | | |
| 4,519,919 | A * | 5/1985 | Whyte | C02F 1/481 | 210/222 |
| 5,997,812 | A * | 12/1999 | Burnham | A23L 2/50 | 210/695 |
| 6,743,399 | B1 * | 6/2004 | Weigl | B01F 5/0646 | 422/500 |
| 2005/0200442 | A1 * | 9/2005 | Boen | B01F 13/0809 | 336/10 |
| 2010/0233822 | A1 * | 9/2010 | Prins | B01F 13/0809 | 436/164 |
| 2012/0024691 | A1 * | 2/2012 | Gogichev | B01F 13/0809 | 204/155 |

FOREIGN PATENT DOCUMENTS

| | | | |
|---|---|---|---|
| JP | 62-007789 | A | 1/1987 |
| WO | 97/01702 | A1 | 1/1997 |
| WO | 2011/086522 | A1 | 7/2011 |

* cited by examiner

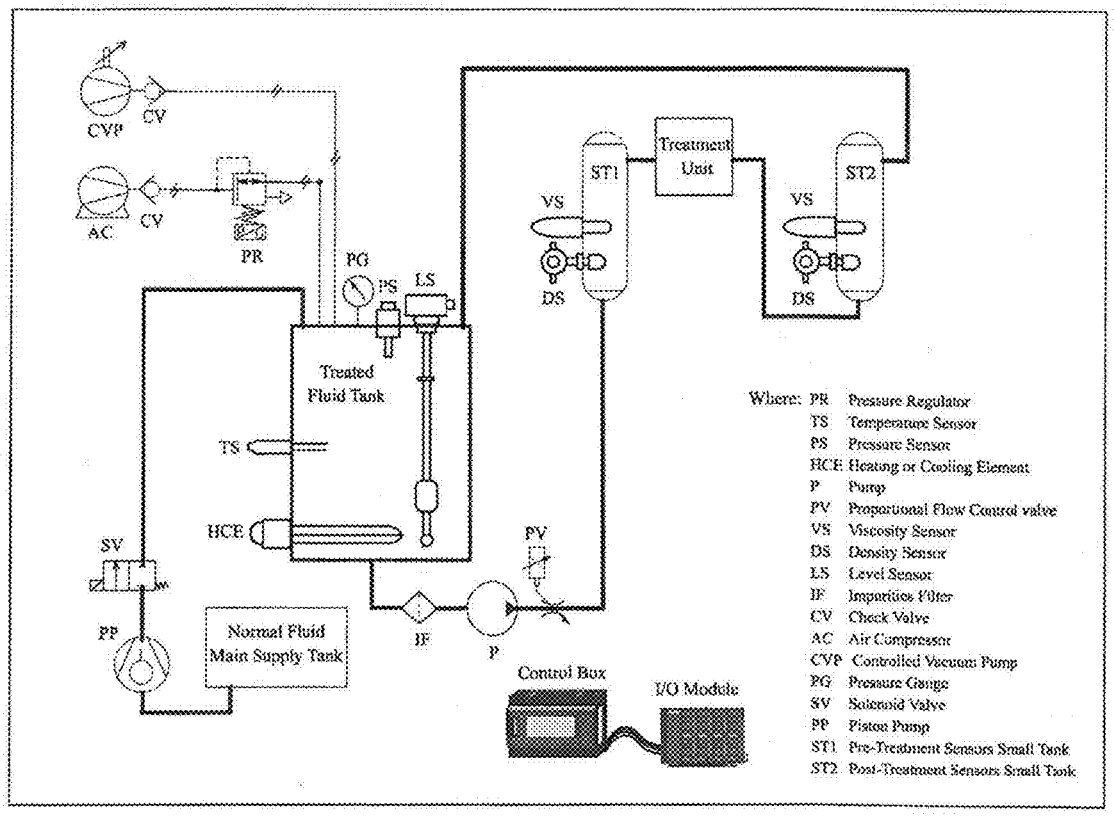
Figure 1: an exemplary production process of the directly magnetized or treated fluid/gas using Inline pre-treatment and post-treatment sensors configuration.

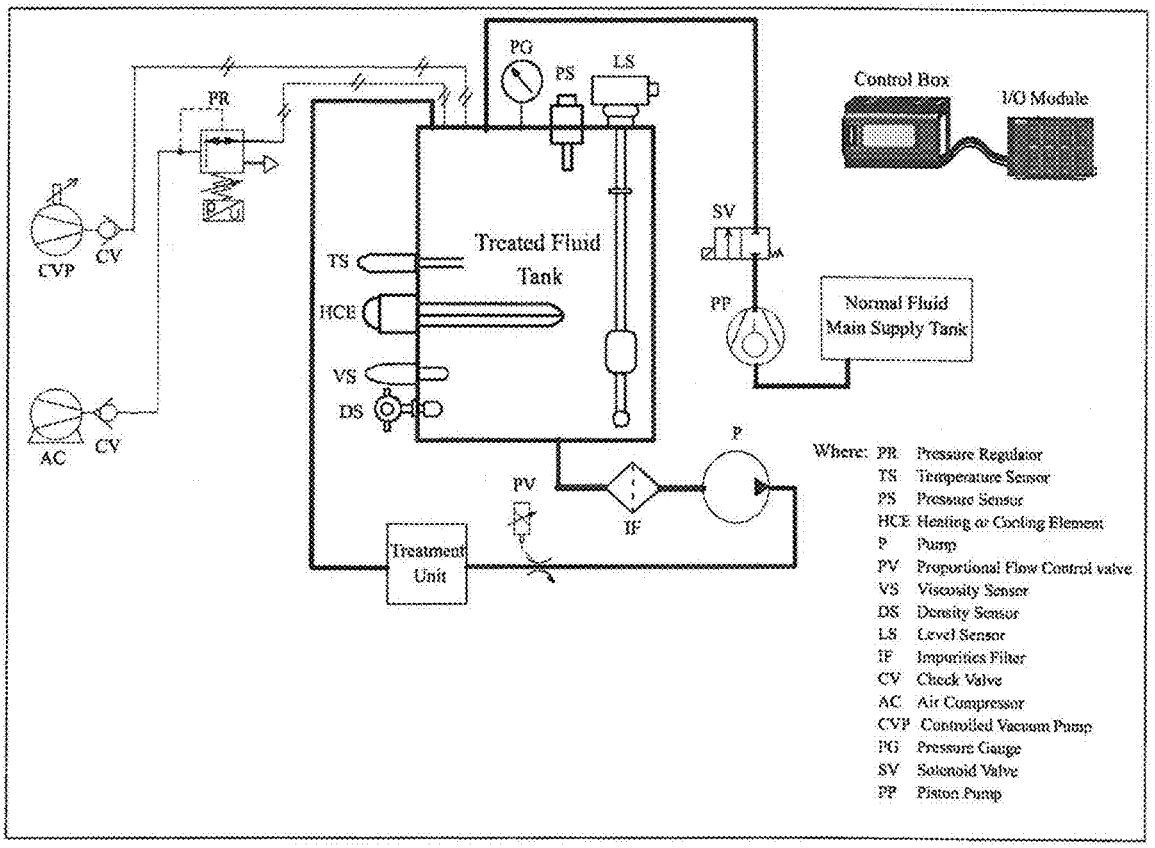
Figure 2: an exemplary production process of the directly magnetized or treated fluid/gas using In-tank sensors configuration

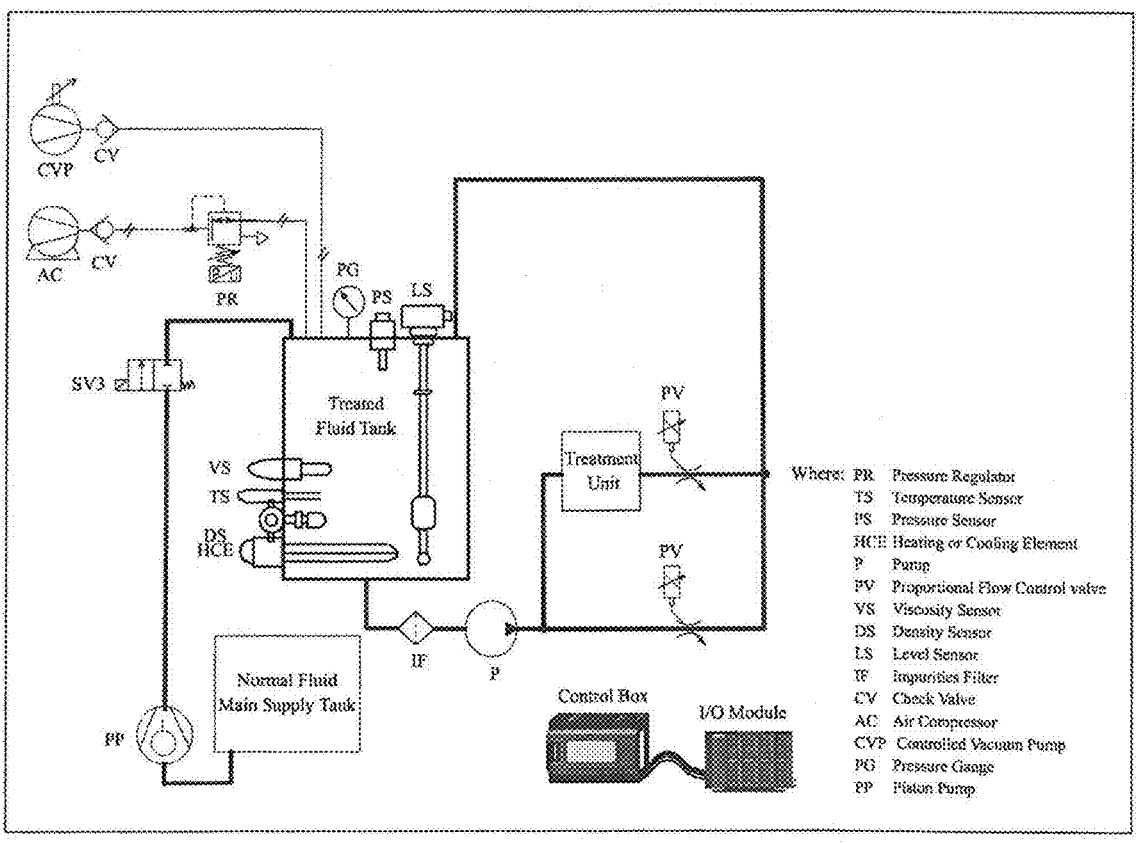
Figure 3: an exemplary production process of the directly magnetized or treated fluid/gas using Parallel flow configuration

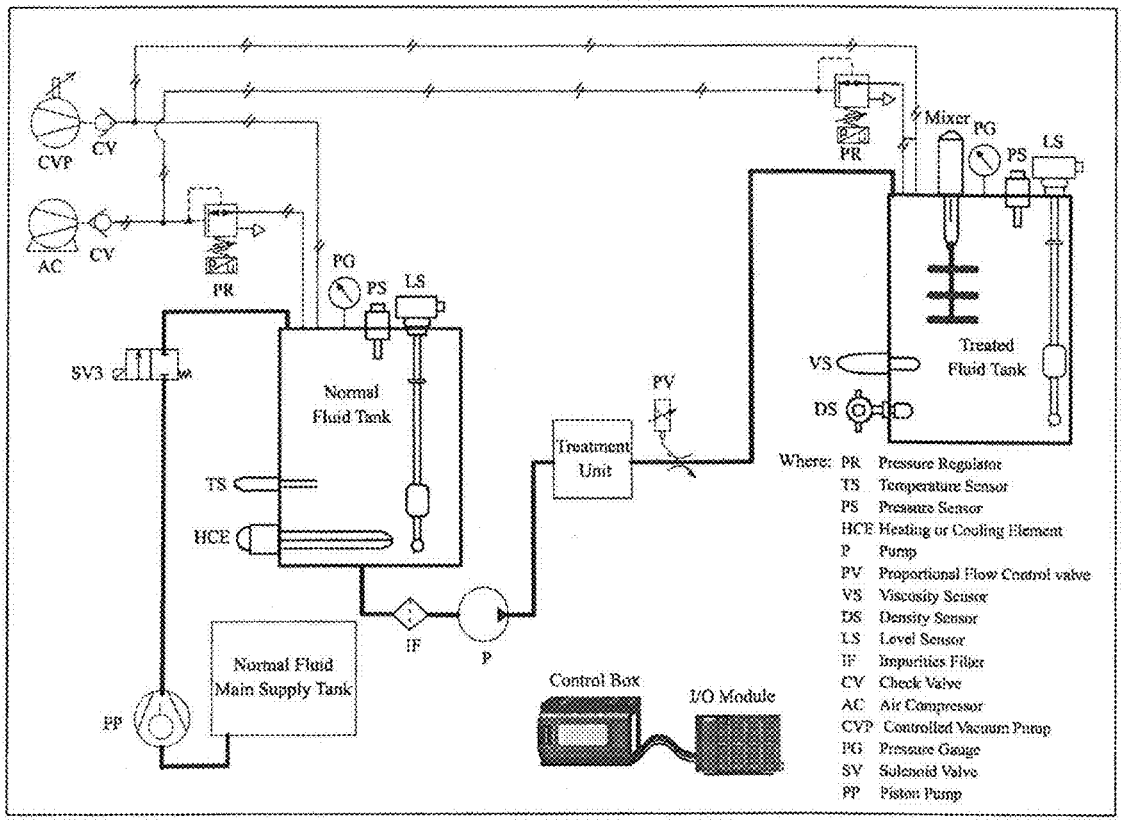
Figure 4: an exemplary production process of the directly magnetized or treated fluid/gas using Single-cycle configuration.

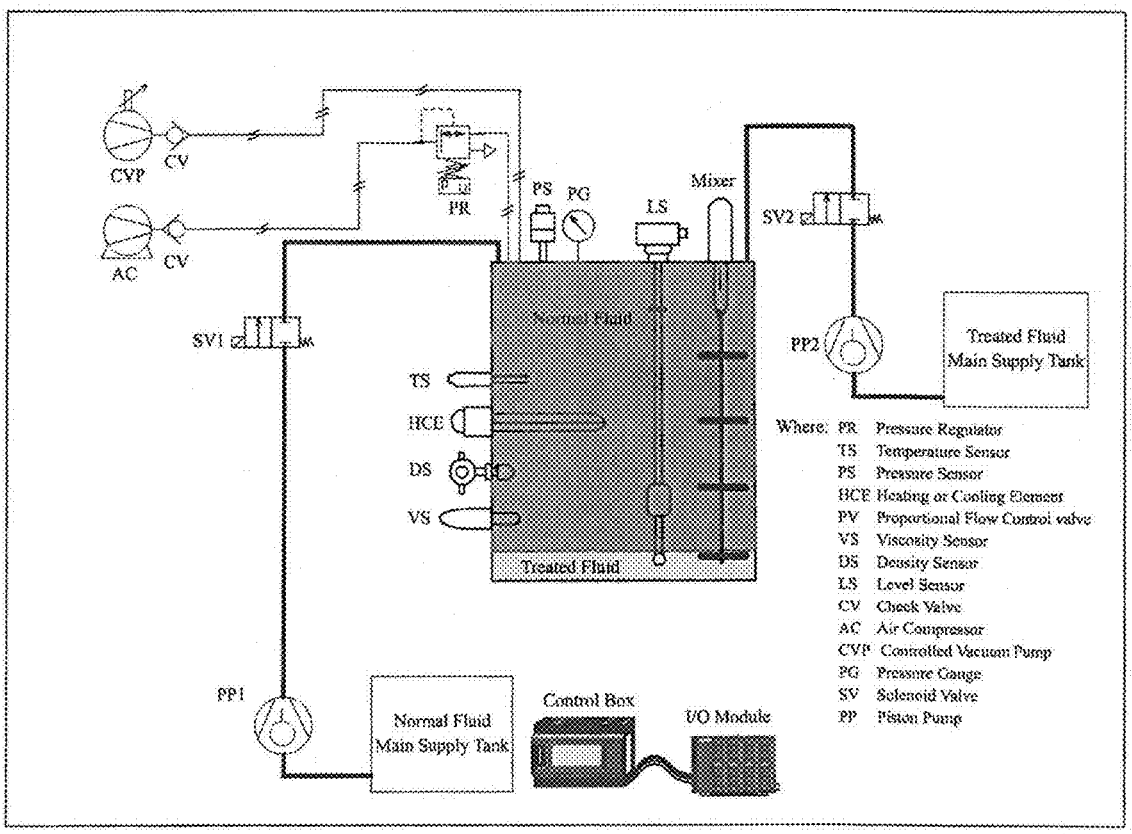
Figure 5: an exemplary mixing process using Bottom configuration

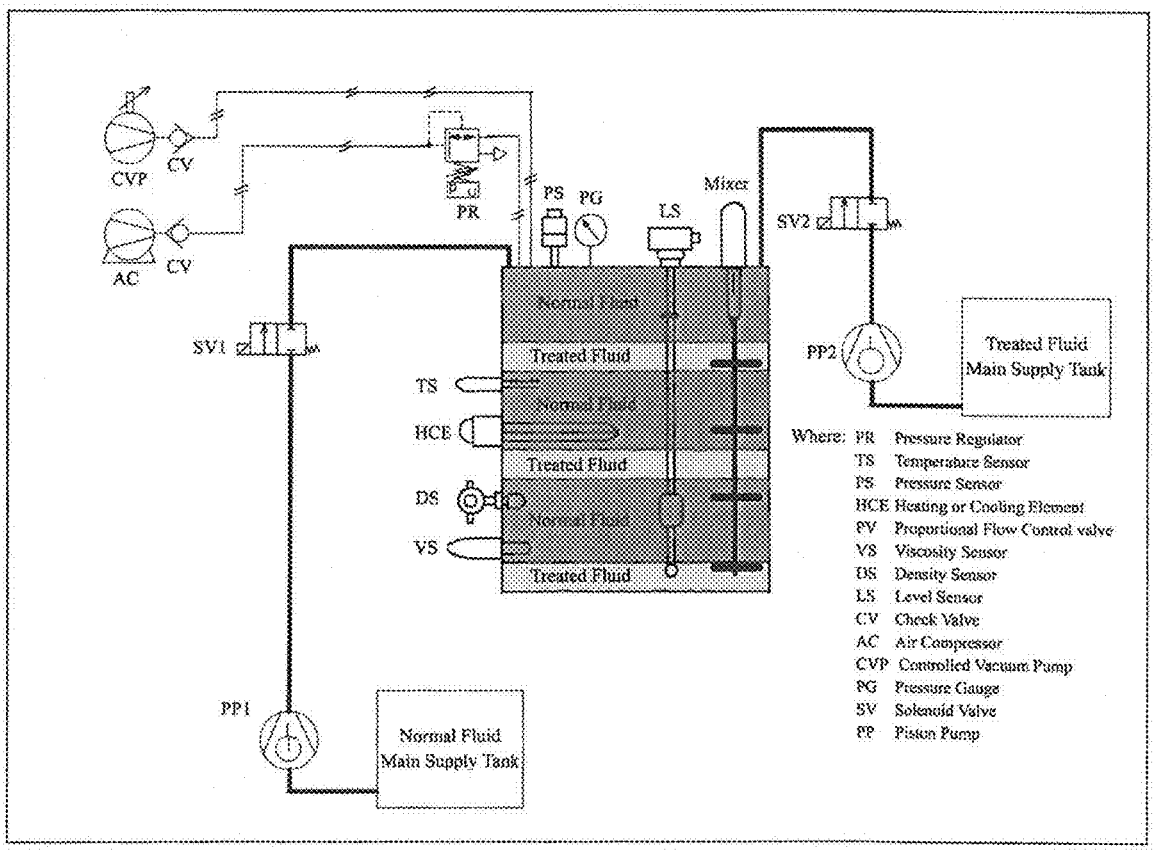
Figure 6: an exemplary mixing process using Alternative bottom configuration

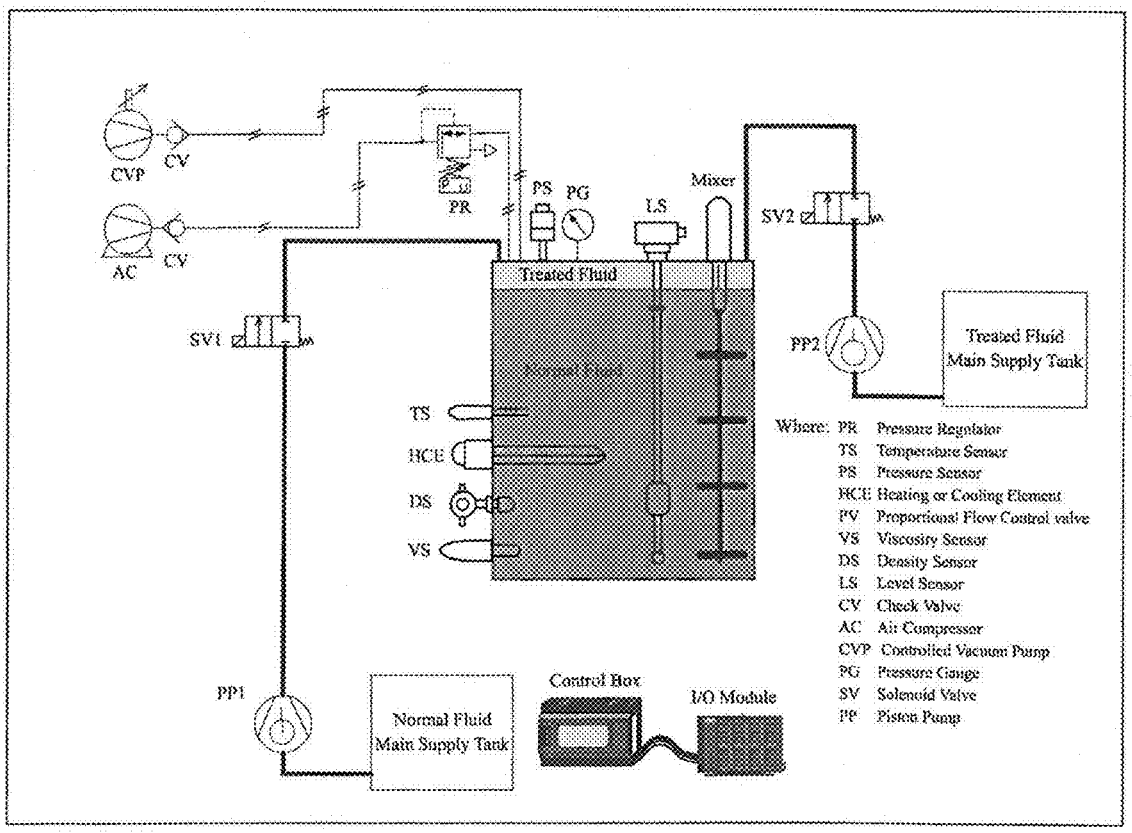
Figure 7: an exemplary mixing process using Top configuration

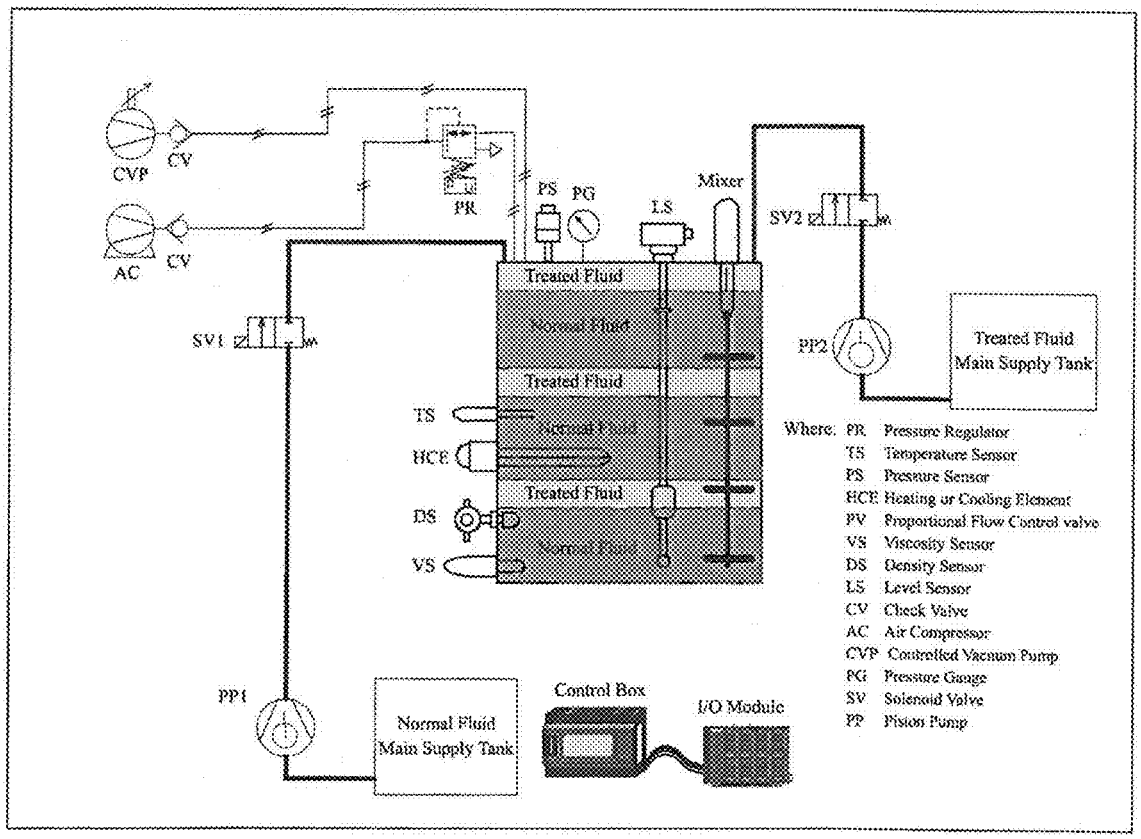
Figure 8: an exemplary mixing process using Alternative top configuration

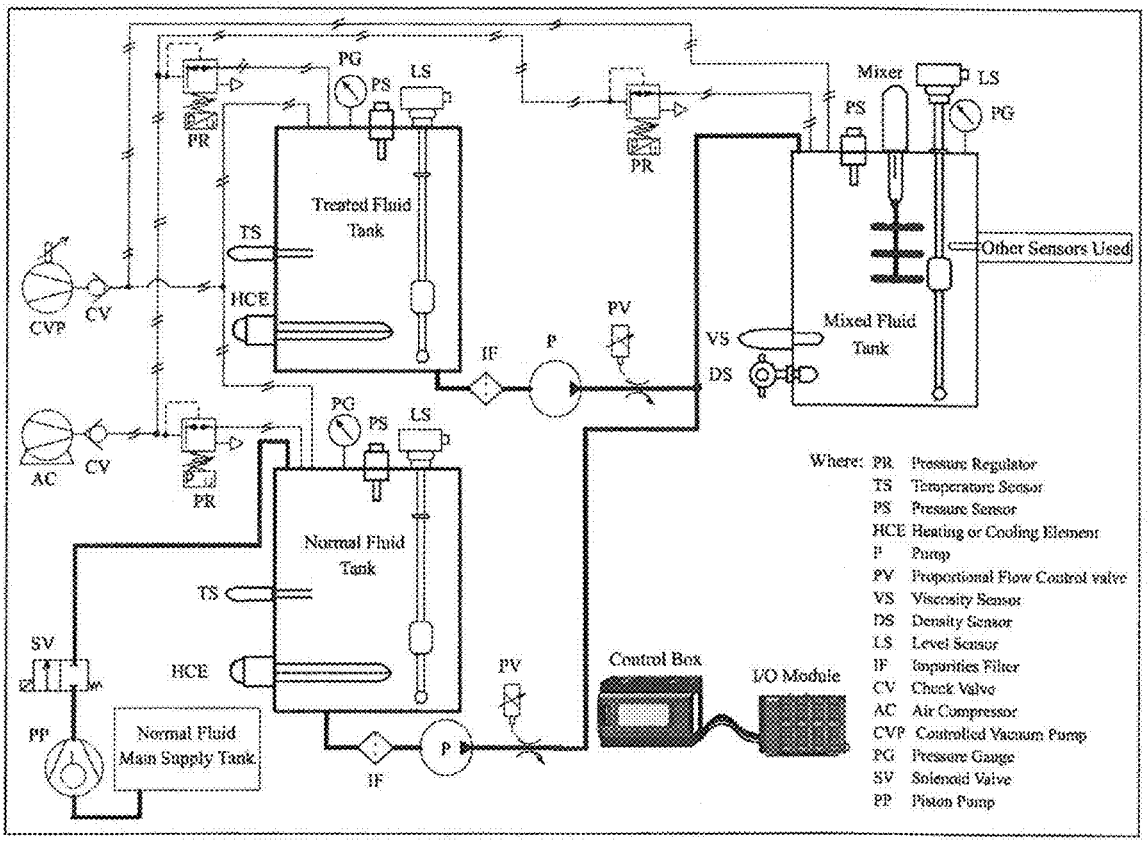
Figure 9: an exemplary mixing process using Parallel flow two-tank configuration

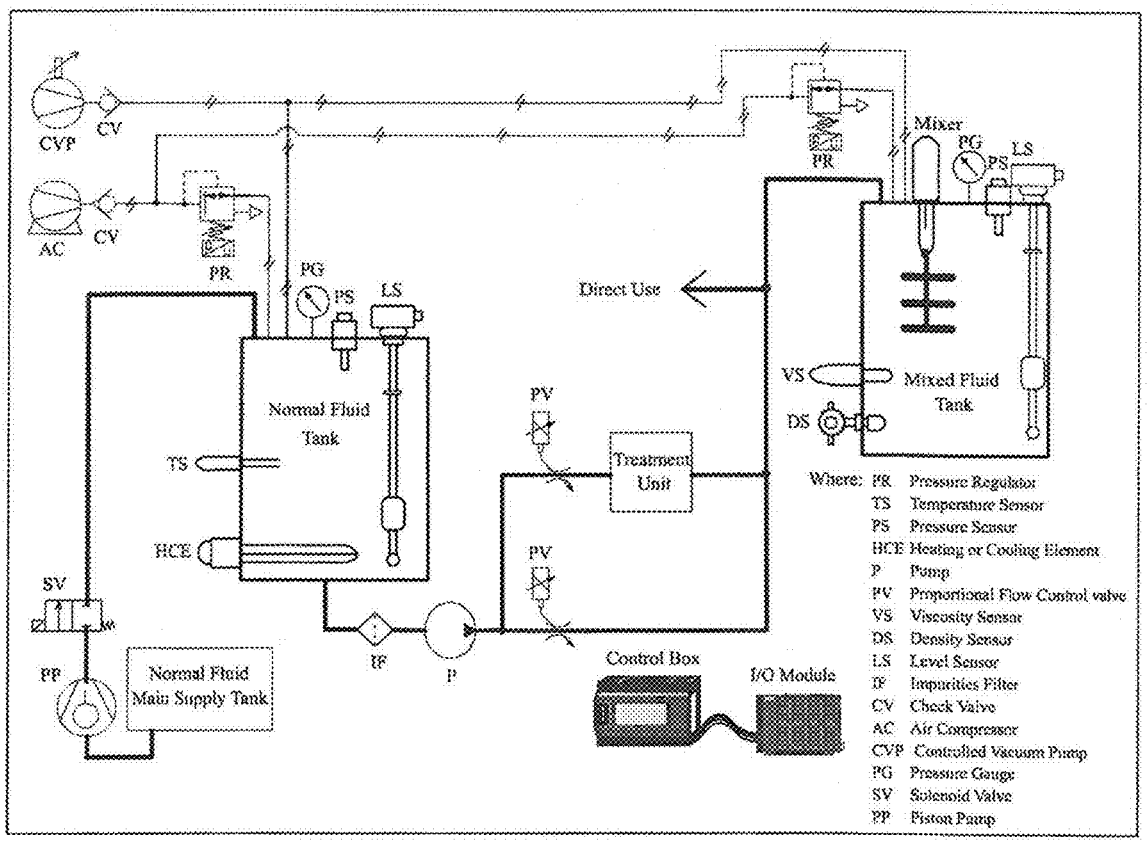
Figure 10: an exemplary mixing process using Parallel flow one-tank configuration

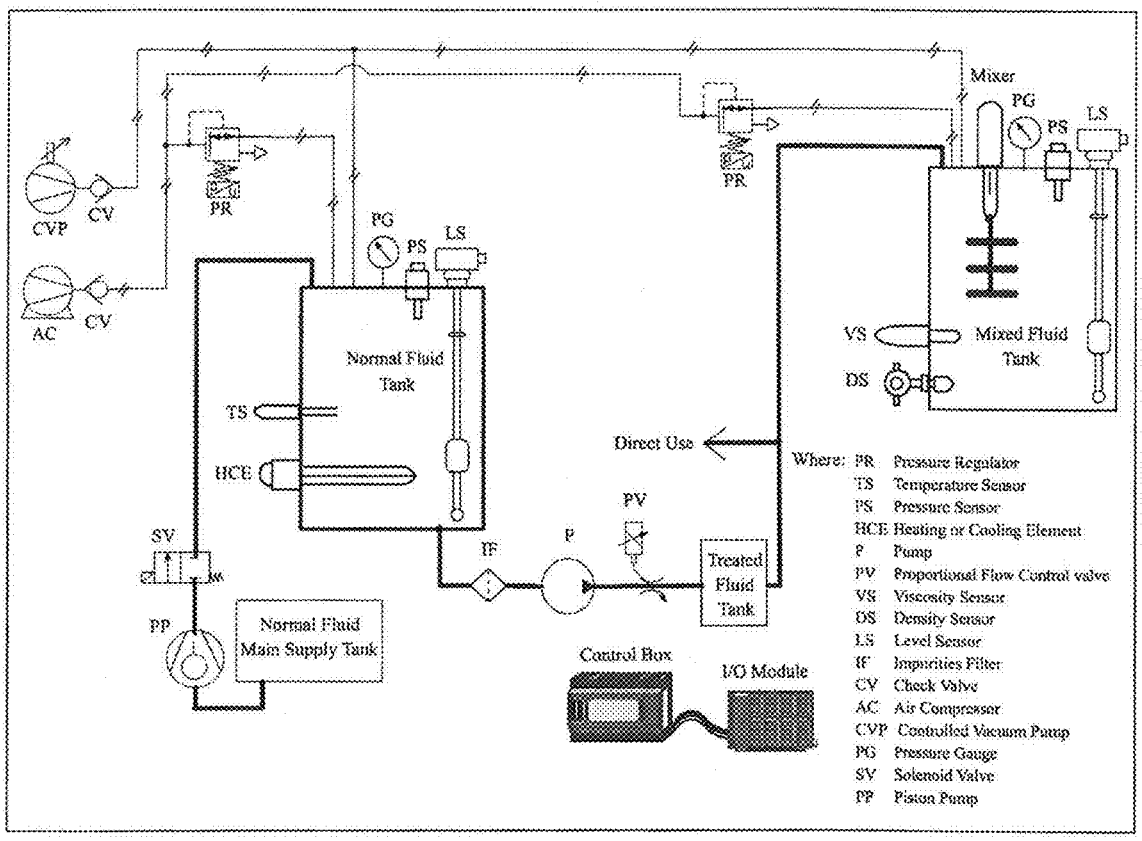
Figure 11: an exemplary mixing process using Series flow one-tank configuration

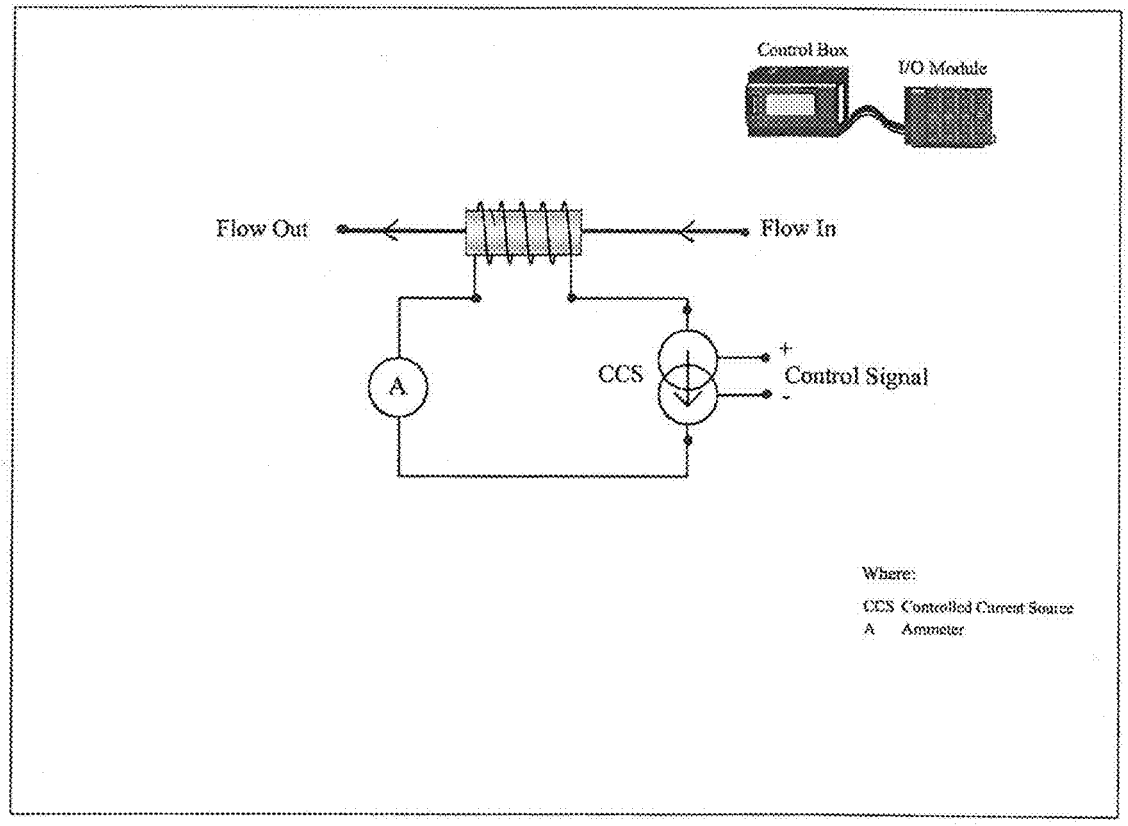
Figure 12: an exemplary Coil setup for generating variable electromagnetic field.

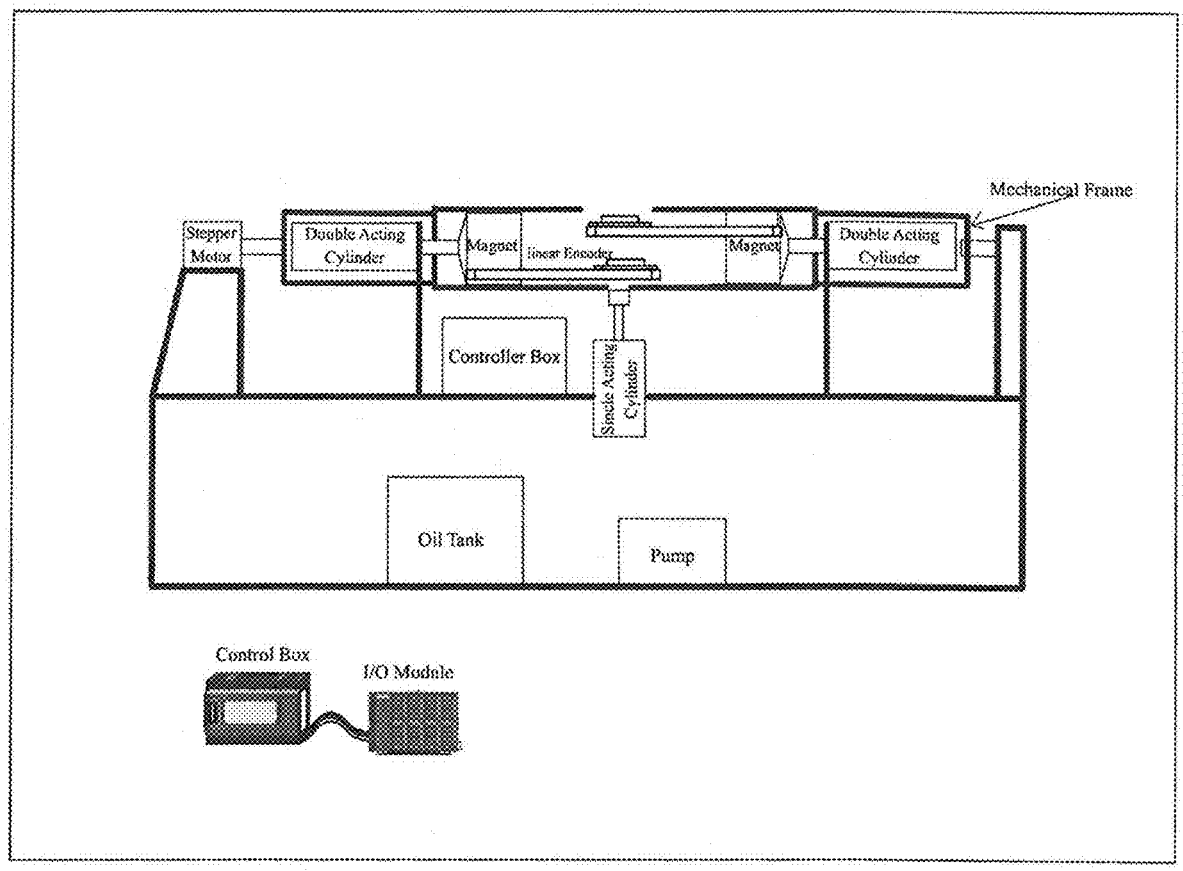
Figure 13: an exemplary Permanent magnet setup for generating variable magnetic field.

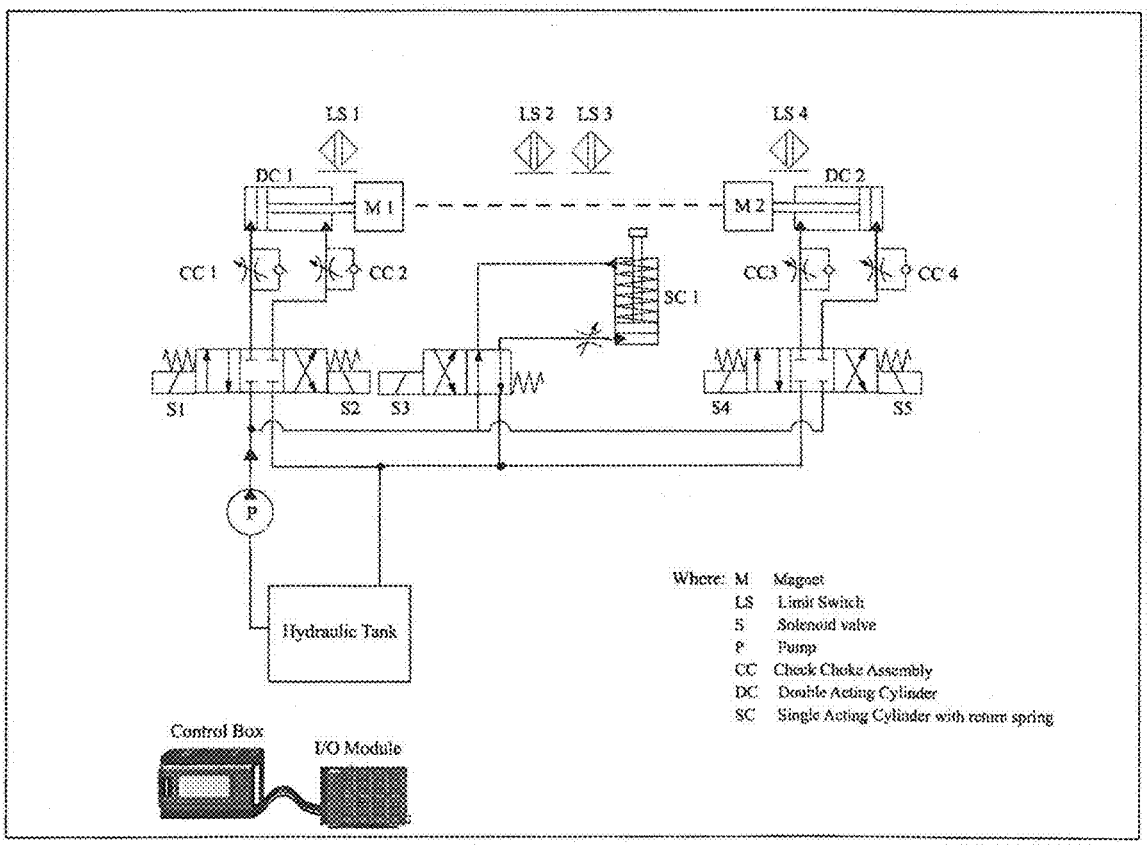
Figure 14: an exemplary Hydraulic Circuit for permanent magnet setup.

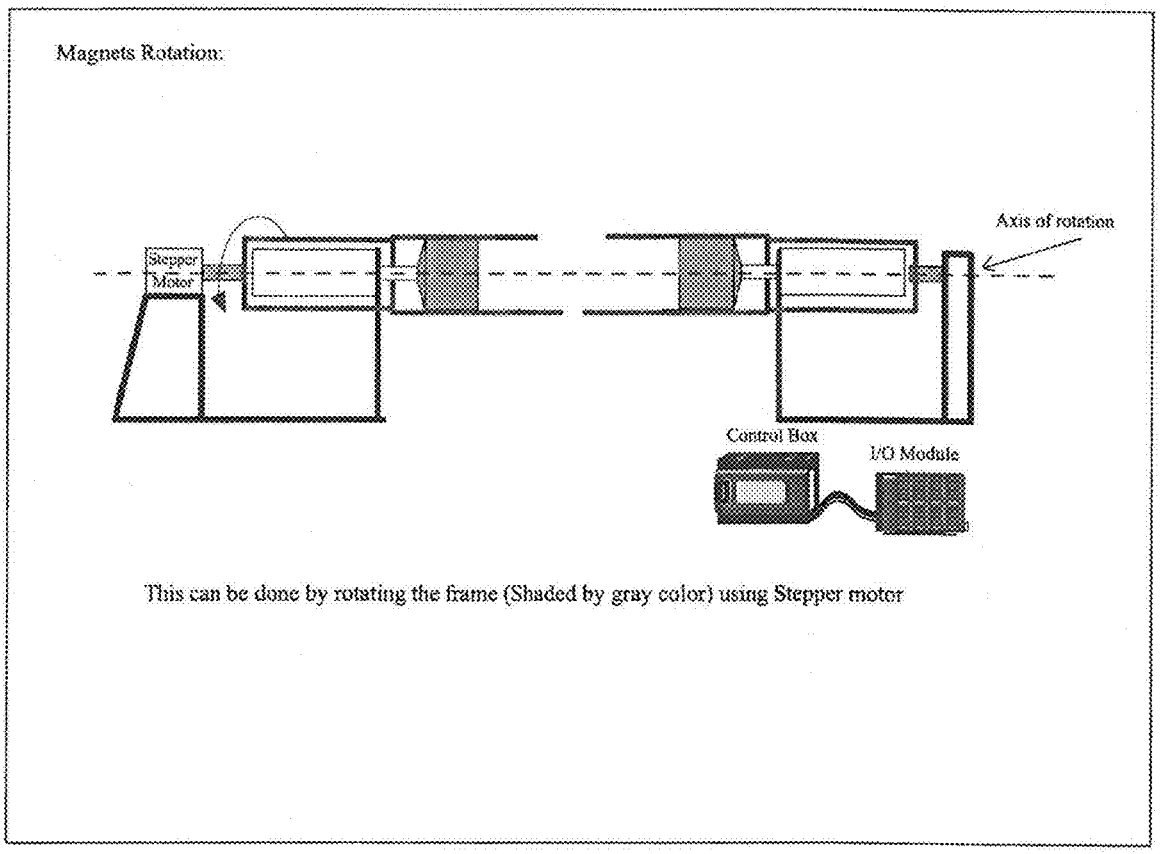
Figure 15: an exemplary Magnets Rotation of Permanent magnet setup using stepper motor.

Magnets field flipping:
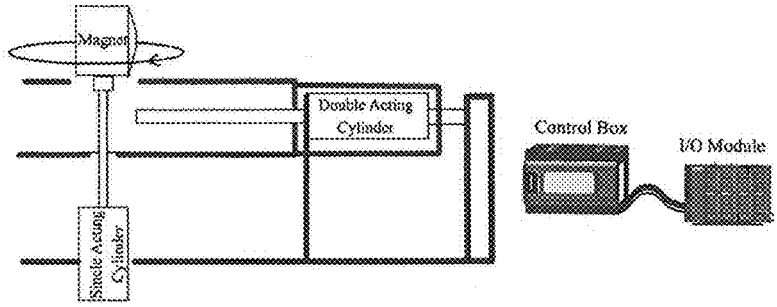
To flip magnets field, one of magnets must move to its maximum outstroke where the piston of single acting cylinder will lift it from the bottom to the top of frame where the magnet flipped manually.
Figure 16: an exemplary Magnetic filled polarity manual flipping of permanent magnet setup.

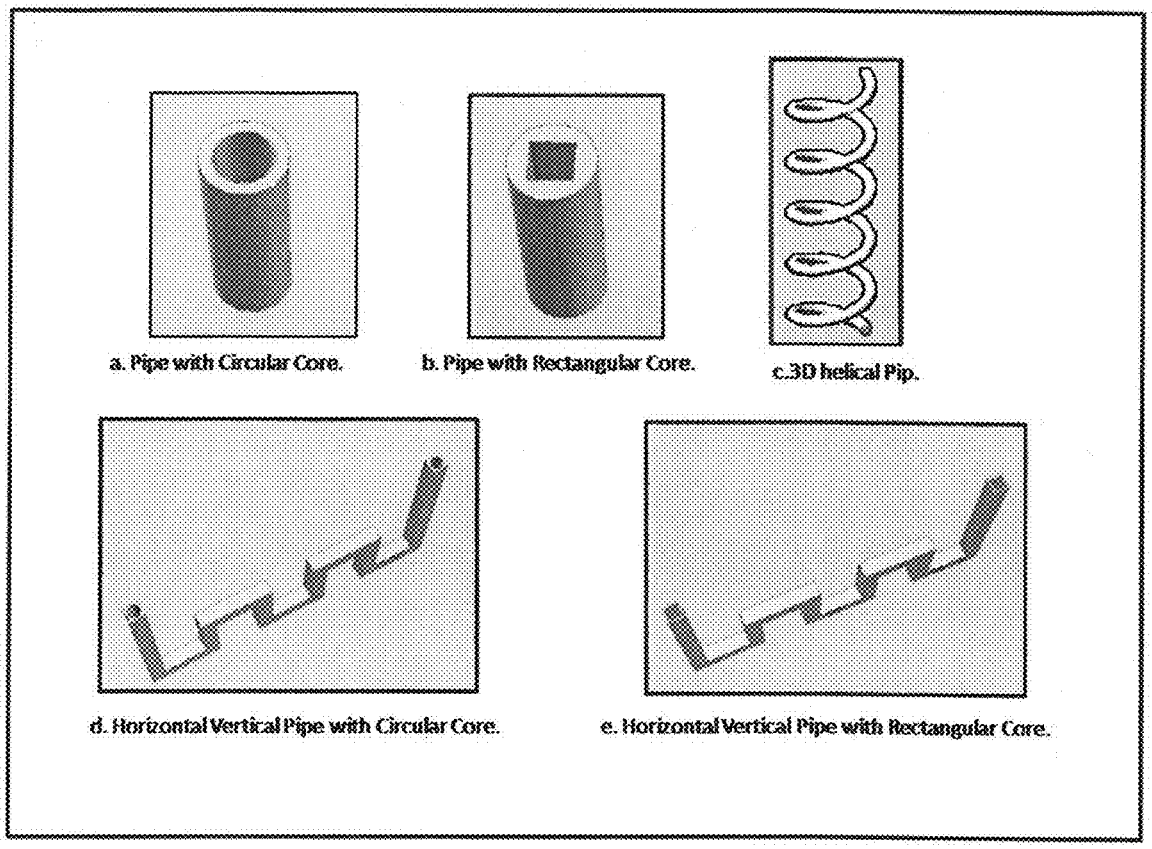
Figure 17: exemplary Possible Pipe configurations under the effect of magnetic field.

| Distance (Cm) | $B_X$ (G) | $B_Y$ (G) | $B_Z$ (G) |
|---|---|---|---|
| 2.4 | 6841 | 10.39 | 26.20 |
| 3.4 | 5892 | 28.04 | 26.80 |
| 4.4 | 4711 | 49.94 | 25.09 |
| 5.4 | 3982 | 85.05 | 22.56 |
| 6.4 | 3374 | 112.90 | 19.93 |
| 7.4 | 2859 | 136.10 | 17.40 |
| 8.4 | 2417 | 154.30 | 15.16 |
| 9.4 | 2131 | 169.93 | 13.58 |
| 10.4 | 1836 | 176.00 | 11.94 |
| 11.4 | 1631 | 183.80 | 10.58 |
| 12.4 | 1416 | 193.20 | 9.23 |
| 13.4 | 1272 | 199.60 | 8.19 |
| 14.4 | 1129 | 206.20 | 7.19 |
| 15.4 | 1011 | 211.76 | 6.40 |
| 16.4 | 902 | 217.07 | 5.60 |
| 17.4 | 812 | 221.30 | 5.03 |
| 18.4 | 733 | 225.30 | 4.40 |
| 19.4 | 662 | 228.79 | 3.90 |
| 20.4 | 596 | 232.00 | 3.55 |
| 21.4 | 544 | 234.70 | 3.21 |
| 22.4 | 492 | 237.30 | 2.82 |
| 23.4 | 454 | 239.30 | 2.62 |
| 24.4 | 411 | 214.60 | 2.33 |
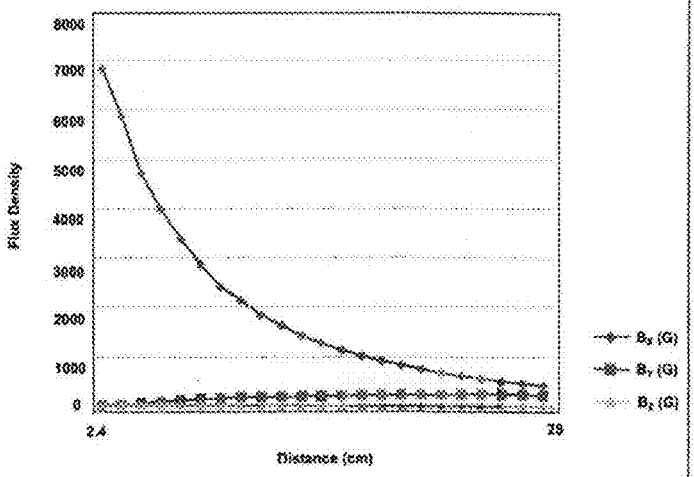
Figure 18: an exemplary 3D Flux density of permanent magnet setup using attraction mode used in the application case.

| Distance (Cm) | $B_X$ (G) | $B_Y$ (G) | $B_Z$ (G) |
|---|---|---|---|
| 2.4 | 7.9 | 480.00 | 580.00 |
| 3.4 | 0.16 | 352.00 | 330.00 |
| 4.4 | 6.8 | 226.00 | 395.00 |
| 5.4 | 2.51 | 122.30 | 333.00 |
| 6.4 | 4.6 | 20.00 | 272.00 |
| 7.4 | 14.9 | 60.80 | 263.00 |
| 8.4 | 11.72 | 112.60 | 220.00 |
| 9.4 | 10.5 | 143.10 | 207.00 |
| 10.4 | 9.1 | 162.50 | 189.40 |
| 11.4 | 15.86 | 184.90 | 169.80 |
| 12.4 | 5.3 | 192.60 | 154.03 |
| 13.4 | 4.31 | 202.20 | 146.80 |
| 14.4 | 3.3 | 210.40 | 128.00 |
| 15.4 | 5.9 | 221.90 | 111.50 |
| 16.4 | 2.7 | 226.87 | 98.80 |
| 17.4 | 7.9 | 235.30 | 89.30 |
| 18.4 | 4.11 | 237.00 | 86.30 |
| 19.4 | 1.98 | 239.00 | 73.65 |
| 20.4 | 4.36 | 244.46 | 65.33 |
| 21.4 | 1.09 | 245.20 | 59.10 |
| 22.4 | 0.367 | 247.00 | 53.10 |
| 23.4 | 0.3 | 296.70 | 48.70 |
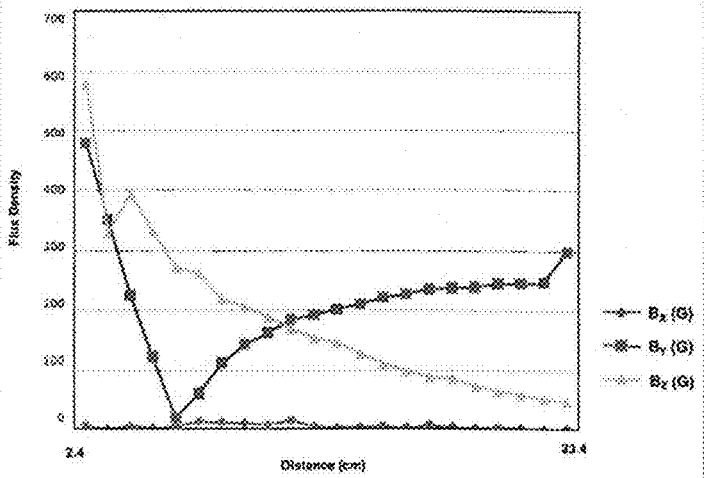
Figure 19: an exemplary 3D Flux density of permanent magnet setup using repulsion mode used in the application case.

METHOD AND APPARATUS FOR INDIRECT MAGNETIC TREATMENT OF FLUIDS AND GASES

CROSS REFERENCE TO RELATED APPLICATIONS

This application is a National Stage of International Application No. PCT/EP2012/059164 filed May 16, 2012, claiming priority based on Patent Canadian Application No. 2,740,584 filed May 19, 2011, the contents of all of which are incorporated herein by reference in their entirety.

FIELD OF THE INVENTION

The present invention pertains generally to the field of magnetic treatment of fluids and/or gases, and more specifically to a method and apparatus for indirect magnetic treatment of fluids and gases, that are based primarily on the mixing between directly magnetized fluids/gases (fluids/gases that are treated using direct magnetic or electromagnetic field of certain geometry and flux density) and normal non-magnetized fluids/gases to obtain new mixed or indirectly-magnetized fluids/gases that have better performance than the directly magnetized fluids/gases and normal non-magnetized fluids/gases.

BACKGROUND OF THE INVENTION

Magnetohydrodynamics (MHD) (magnetofluiddynamics or hydromagnetics) is the scientific discipline that studies the dynamics of electrically conducting fluids under the effect of magnetic fields. MHD is derived from "magneto" meaning magnetic field, and "hydro" meaning liquid, and "dynamics" meaning movement or motion. The field of MHD was initiated by Hennes Alfvén in 1942, for which he received the Nobel Prize in Physics in 1970.

The idea of MHD is that magnetic fields can induce currents in a moving electrically-conductive fluid, which create mechanical forces on the fluid, and also change the magnetic field itself. The set of equations which describe MHD are a combination of the familiar Navier-Stokes equations of fluid dynamics and Maxwell's equations of electromagnetism. Research studies indicate that magnetohydrodynamic effects are responsible for the magnetic treatment of fluids and gases.

All previous applications of magnetic treatment of fluids and gases focused on the direct application of magnetic or electromagnetic fields of various flux densities and variable geometries on the moving fluid or gas, where the entire or the totality of the fluid or gas should pass directly through the magnetic or the electromagnetic field in order to be treated. This direct treatment fact is the hidden obstacle for the limited popularity of the magnetic treatment since it leads to effective treatment only in the initial phases of installation of magnetic treatment devices, and generally ineffective treatment in the later stages.

SUMMARY OF THE INVENTION

It is therefore an object of the present invention to provide a method and apparatus for indirect magnetic treatment of fluids and gases that overcomes the drawbacks of direct magnetic treatment of fluids and gases.

There is provided a method of indirect treatment of fluids or gases, the method comprising: providing a first fluid or gas; applying a direct magnetic or electromagnetic field of certain flux densities and geometries on the first fluid or gas to obtain the directly magnetized fluid/gas; providing a second normal non-magnetized fluid/gas; and mixing the first directly magnetized fluid/gas with the second normal non-magnetized fluid/gas to obtain a third mixed or indirectly-magnetized fluid/gas that is also treated and more effective than the first directly magnetized fluid/gas and the second normal non-magnetized fluid/gas.

This means that according to the present invention, the first fluid/gas is the directly magnetized fluid/gas that undergoes direct magnetic or electromagnetic treatment, while the second fluid/gas is the normal non-magnetized fluid/gas that does not pass through any direct magnetic or electromagnetic field. In the third mixed or indirectly-magnetized fluid/gas, the second normal non-magnetized fluid/gas becomes treated indirectly from the first directly magnetized fluid/gas, and the third mixed or indirectly-magnetized fluid/gas becomes totally treated in an indirect manner. In other words, the first directly magnetized fluid/gas serves as a magnetizer or a magnetic treating agent for magnetizing the second normal non-magnetized fluid/gas In the sense of the present invention, the term "directly magnetized" or "directly treated" or simply "treated" referring to fluids and/or gases particularly means that fluid(s) and/or gas(es) are treated or magnetized, respectively, using direct magnetic or electromagnetic field of certain geometry and flux density, which may be provided, for example, by a device or unit producing said respective field. Furthermore, the term "normal non-magnetized" or "normal", respectively, which refers to fluids and/or gases, particularly means that the respective fluid(s) and/or gas(es) is not magnetized or does or did not pass through any direct magnetic or electromagnetic field. Additionally, the term "mixed" or "indirectly-magnetized" referring to fluids and/or gases particularly means that fluid(s) and/or gas(es) that becomes magnetically treated in an indirect manner by the directly magnetized fluid/gas that serves as a magnetizer or a magnetic treating agent. Besides, the term "indirect magnetic fluid/gas treatment" particularly means that a normal fluid and/or gas is treated or magnetized, respectively, without being the object of direct magnetic or electromagnetic field (as it is the case with regard to the "directly magnetized" fluid and/or gas), but by being (for example mixed with and thus) magnetized by a "directly magnetized" fluid and/or gas.

Preferably, the mixing between the first directly magnetized fluid/gas and second normal non-magnetized fluid/gas is carried out in according with a predetermined mixing ratio, where the majority of mixture is of the second normal non-magnetized fluid/gas.

Preferably, the treatment unit that is used for the production of the directly magnetized fluid/gas can be either a permanent magnet setup or an electromagnetic setup using a coil and a controlled current source. The magnetic or electromagnetic field in the treatment unit can be of any geometry (one-dimensional, two-dimensional, or three-dimensional magnetic fields according to the desired flux density values of $B_x$, $B_y$, and $B_z$); the nature of magnetic field can be in the attraction form or in the repulsion form (in case of permanent magnet setup); The required angle between the magnetic field and the direction of fluid/gas flow can be of any angle like 90, 0, 180 degrees or any other required angle.

Preferably, the process of applying magnetic or electromagnetic fields of certain flux densities and geometries on the directly magnetized fluid/gas within the treatment unit is carried out while the fluid/gas is in circulation.

Preferably, the production process of the directly magnetized fluid/gas can be achieved using the "inline pre-treatment and post-treatment sensors configuration" that comprises of: first, filling the normal non-magnetized fluid/gas in the treatment vessel from the normal fluid main supply tank; and second, performing a circulation process of a controlled flow through the treatment unit that outputs its flow back to the treatment vessel. In this configuration, a group of required sensors (that may be application and fluid dependent) are installed before and after the treatment unit that sends its sensory data to the control box in order to trace the changes in the physical and chemical quantities of the directly magnetized fluid/gas with time before and after the treatment unit for analysis purposes.

Alternatively, the production process of the directly magnetized fluid/gas can be also achieved using the "in-tank sensors configuration" that comprises of: first, filling the normal non-magnetized fluid/gas in the treatment vessel from the normal fluid main supply tank; and second, performing a circulation process of a controlled flow through the treatment unit that outputs its flow back to the treatment vessel. In this configuration, a group of required sensors (that may be application and fluid dependent) are installed in the treatment vessel that the sends its sensory data to the control box in order to trace the changes in the physical and chemical quantities of the directly magnetized fluid/gas with time for the fluid/gas in the treatment tank.

Alternatively, the production process of the directly magnetized fluid/gas can be also achieved using the "parallel flow configuration" that comprises of: first, filling the normal non-magnetized fluid/gas in the treatment vessel from the normal fluid main supply tank; and second, performing a circulation process of a controlled flow where the treatment vessel simultaneously receives a first controlled flow through the treatment unit and a second controlled flow directly from the treatment vessel.

Alternatively, the production process of the directly magnetized fluid/gas can be also achieved using the "single-cycle configuration" that comprises of: first, filling the normal non-magnetized fluid/gas in the normal fluid vessel from the normal fluid main supply tank; and second, performing a controlled flow to a second treatment vessel that receives a controlled flow through the treatment unit.

Preferably, the mixing process can be achieved using the bottom configuration that comprises of: first, depositing the first directly magnetized fluid/gas in the bottom of a mixing vessel; and second depositing the second normal non-magnetized fluid/gas on the top of the first directly magnetized fluid/gas. This process might be also repeated many times (alternative bottom configuration).

Alternatively, the mixing process can also be achieved using the top configuration that comprises of: first, depositing the second normal non-magnetized fluid/gas in the bottom of a mixing vessel; and second, depositing the first directly magnetized fluid/gas on the top of the second normal non-magnetized fluid/gas. This process might be also repeated many times (alternative top configuration).

Alternatively, the mixing process can also be achieved using the parallel flow two-tank configuration that comprises of: providing a first vessel for receiving the first directly magnetized fluid/gas; providing a second vessel for receiving the second normal non-magnetized fluid/gas; and providing a third vessel for receiving the third mixed or indirectly-magnetized fluid/gas that is in connection with the first and second vessels for simultaneously receiving a first controlled flow of the first directly magnetized fluid/gas and a second controlled flow of the second normal non-magnetized fluid/gas.

Alternatively, the mixing process can also be achieved using the parallel flow one-tank configuration that comprises of: providing an inline magnetic treatment unit for applying the magnetic or electromagnetic field of certain flux densities and geometries on the second normal non-magnetized fluid/gas to yield the first directly magnetized fluid/gas instantaneously; and providing a first vessel for normal non-magnetized fluid/gas in connection with the treatment unit and with a second vessel for the mixed or indirectly-magnetized fluid/gas; where the treatment unit receives from the first vessel a controlled flow of the second normal non-magnetized fluid/gas and applies the magnetic or electromagnetic field on the second fluid/gas; and where the second vessel simultaneously receives a first controlled flow of the first directly magnetized fluid/gas from the treatment unit and a second controlled flow of the second normal non-magnetized liquid from the first vessel.

Alternatively, the mixing process can also be achieved using the series flow one-tank configuration that comprises of: providing a first vessel for receiving the second normal non-magnetized fluid/gas; providing a second smaller vessel for receiving the first directly magnetized fluid/gas, and providing a third vessel for receiving the mixed or indirectly-magnetized fluid/gas, where the second small vessel receives a controlled flow of the second normal non-magnetized fluid/gas from the first vessel and outputs a flow of mixed or indirectly-magnetized fluid/gas for the third vessel comprising the first directly magnetized and second normal non-magnetized fluid/gas.

As a further aspect of the invention, there are provided apparatuses for the production of directly magnetized fluid/gas that include inline pre-treatment and post-treatment sensors configuration as shown in FIG. 1, in-tank sensors configuration as shown in FIG. 2, parallel flow configuration as shown in FIG. 3, single-cycle configuration as shown in FIG. 4.

As a further aspect of the invention, there are provided apparatuses for the mixing processes that include bottom configuration as shown in FIG. 5, alternative bottom configuration as shown in FIG. 6, top configuration as shown in FIG. 7, alternative top configuration as shown in FIG. 8, parallel flow two-tank configuration as shown in FIG. 9, parallel flow one-tank configuration as shown in FIG. 10, series flow one-tank configuration as shown in FIG. 11.

As another aspect of the invention, there is provided a method of treating a fluid/gas, the method comprising using a first directly magnetized fluid/gas as a magnetizer or a magnetic treating agent for magnetizing the second normal non-magnetized fluid/gas.

Preferably, using the first directly magnetized fluid/gas as a magnetizer or a magnetic treating agent for magnetizing the second normal non-magnetized fluid/gas comprises mixing the first and second fluid/gas in accordance with a predetermined mixing ratio.

BRIEF DESCRIPTION OF THE DRAWINGS

Further features and advantages of the present invention will become apparent from the following detailed description, taken in combination with the appended drawings, in which:

FIG. 1: shows an exemplary production process of the directly magnetized fluid/gas using inline pre-treatment and post-treatment sensors configuration.

FIG. 2: shows an exemplary production process of the directly magnetized fluid/gas using In-tank sensors configuration FIG. 3: shows an exemplary production process of the directly magnetized fluid/gas using Parallel flow configuration FIG. 4: shows an exemplary production process of the directly magnetized fluid/gas using Single-cycle configuration.

FIG. 5: shows an exemplary mixing process using Bottom configuration

FIG. 6: shows an exemplary mixing process using Alternative bottom configuration FIG. 7: shows an exemplary mixing process using Top configuration FIG. 8: shows an exemplary mixing process using Alternative top configuration FIG. 9: shows an exemplary mixing process using Parallel flow two-tank configuration FIG. 10: shows an exemplary mixing process using Parallel low one-tank configuration FIG. 11: shows an exemplary mixing process using Series flow one-tank configuration FIG. 12: shows an exemplary Coil setup for generating variable electromagnetic field.

FIG. 13: shows an exemplary Permanent magnet setup for generating variable electromagnetic field.

FIG. 14: shows an exemplary Hydraulic Circuit for permanent magnet setup.

FIG. 15: shows an exemplary Magnets Rotation of Permanent magnet setup using stepper motor.

FIG. 16: shows an exemplary agnetic field polarity manual flipping of permanent magnet setup.

FIG. 17: shows exemplary Possible Pipe configurations under the effect of magnetic field.

FIG. 18: shows an exemplary three-dimensional Flux density of permanent magnet setup using attraction mode used in the application case.

FIG. 19: shows an exemplary three-dimensional Flux density of permanent magnet setup using repulsion mode used in the application case.

DETAILED DESCRIPTION OF THE INVENTION

In accordance with a first aspect of the present invention, there is, as an example, provided a method for indirect magnetic fluid/gas treatment where the normal fluid/gas is magnetically treated without being the object of direct magnetic or electromagnetic field.

The method of indirect magnetic fluid/gas treatment may comprise one, more or all the following steps:

1. Produce the first directly magnetized fluid/gas by:—
   a. applying direct magnetic or electromagnetic field on the working fluid/gas according to one, more or all of the following requirements:
      i. The required geometry of the magnetic field. We can apply one-dimensional, two-dimensional, three-dimensional magnetic fields.
      ii. The required values of the flux densities $B_x$, $B_y$, and $B_z$.
      iii. The nature of magnetic field whether in the attraction form or in the repulsion form. This is applied only in case of permanent magnets.
      iv. The required angle between the magnetic field and the fluid/gas flow where the angle might be 90, 0, 180 degrees or any other required angle,
      v. The required temperature, pressure, and volume of the working fluid/gas.
   b. Circulating the working fluid/gas under the effect of magnetic or electromagnetic field according to the selected treatment configuration (as shown in FIGS. 1 to 4) for the required time of circulation. The circulation process might at least be one time of passage of the working fluid/gas across the magnetic or electromagnetic field and might go up to several days.
2. Mix the first directly magnetized fluid/gas with the second normal non-magnetized fluid/gas at the required mixing ratio between the volume of the first directly magnetized fluid/gas ($V_t$) and the volume of second normal non-magnetized fluid/gas ($V_n$) according to the selected mixing configuration (as shown in FIGS. 5 to 11). The mixing process might be in one of the following forms:
   a. Addition of one type of fluid at a time in a mixing vessel. This process might take one of the following configurations.
      i. Bottom configuration. Add the first directly magnetized fluid/gas at the bottom of the mixing vessel then add the second normal non-magnetized fluid/gas at the top as shown in FIG. 5.
      ii. Alternative bottom configuration. Add the first directly magnetized fluid/gas at the bottom of the mixing vessel then add the second normal non-magnetized fluid/gas at the top. Then repeat this process many times as shown in FIG. 6.
      iii. Top configuration. Add the second normal non-magnetized fluid/gas at the bottom of the mixing vessel then add the first directly magnetized fluid/gas at the top as shown in FIG. 7.
      iv. Alternative top configuration. Add the second normal non-magnetized fluid/gas at the bottom of the mixing vessel then add the directly magnetized fluid/gas at the top. Then repeat this process many times as shown in FIG. 8.
   b. Parallel flow two-tank configuration. In this scenario, we have one tank for directly magnetized fluid/gas, a second tank for the normal non-magnetized fluid/gas and a third tank for the mixed or indirectly-magnetized fluid/gas. Two proportional valves are placed at the first and second tank outputs that control the simultaneous mixing ratio between the directly magnetized fluid/gas and the normal non-magnetized fluid/gas as shown in FIG. 9.
   c. Parallel flow one-tank configuration. In this scenario, we have one tank for the normal non-magnetized fluid/gas and a second tank for the mixed or indirectly-magnetized fluid/gas. Two output pipes are coming out from the first tank in a parallel manner. The first pipe goes through the magnetic treatment unit and the output of the treatment unit (directly magnetized fluid/gas) is mixed in the second mixing tank. Two proportional valves are placed at the first tank outputs that control the simultaneous mixing ratio between the directly magnetized fluid/gas and the normal non-magnetized fluid/gas. Actually this is the case where we don't have a storage tank for the directly magnetized or treated fluid/gas and the fluid/gas is treated instantaneously through the treatment unit before being mixed in the second tank with the normal non-magnetized fluid/gas. It is to be noted that the flow within the magnetic treatment unit might have different internal flow rate during the treatment from the output flow rate coming out of it as shown in FIG. 10.

d. Series flow one-tank configuration. Here a simultaneous series mixing between the directly magnetized fluid/gas and the normal non-magnetized fluid/gas is performed. In this scenario, we have one tank for directly magnetized fluid/gas, second tank for the normal non-magnetized fluid/gas and a third tank for the mixed or indirectly-magnetized fluid/gas. The normal non-magnetized fluid/gas flow from its tank that is controlled by proportional valve and passes through the treated tank where the output flow of treated tank can be used immediately in the application or stored in the third mixed tank. In this case, the volume of the treated tank and the proportional value opening ratio are the controlling parameters as shown in FIG. 11.

3. Use the mixed or indirectly-magnetized fluid/gas in the proper application. In this case, we have two scenarios. In the first scenario, the mixed or indirectly-magnetized fluid/gas is stored in the mixing tank for later use, while in the second scenario; the mixed or indirectly-magnetized fluid/gas is used immediately in the application without being stored in the mixing tank.

It is to be noted that the previously mentioned treatment process have one, more or all of the following controlling parameters that are fluid/gas dependent and application dependent:

1. direct magnetic or electromagnetic field treatment parameters of the directly magnetized fluid/gas:
   a. The dimension and the geometry of the magnetic field (one-dimensional, two-dimensional, three-dimensional).
   b. The desired values of flux densities ($B_k$, $B_y$, $B_z$) depending on the given dimension.
   c. The nature of magnetic field whether in the attraction form or in the repulsion form (in case of permanent magnets setup).
   d. The required angle between the magnetic field and the fluid/gas flow where the angle might be 90 degrees (perpendicular direction), 0 degree (in the same direction), 180 degrees (in the opposite direction) or any other required angle.
   e. The required volume of the directly magnetized fluid/gas.
   f. The required temperature and pressure of the directly magnetized fluid/gas.
   g. The flow rate of the fluid/gas under the effect of the field.
   h. The required circulation time or application time of the magnetic field upon the fluid/gas.
   i. The geometry of the pipes under magnetic treatment and their inner cross sections.
2. mixing process parameters:
   a. The volume of normal non-magnetized fluid/gas.
   b. The volume of directly magnetized fluid/gas.
   c. The required temperature and pressure of the normal non-magnetized fluid/gas and the directly magnetized fluid/gas.
   d. The mixing ratio between the two fluids controlled by the proportional valves openings whenever used.
   e. The mixing flow rates for the normal non-magnetized fluid/gas and the directly magnetized fluid/gas The principal characteristics of the present invention may comprise one, more or all of:

1. Use of directly magnetized or treated fluid/gas as a magnetizer or magnetic treating agent for the normal non-magnetized fluid/gas.
2. Use of the magnetic field stored in the directly magnetized fluid/gas as a treatment methodology for the normal non-magnetized fluid/gas.
3. Use of one-dimensional, two-dimensional, or three-dimensional magnetic geometries of certain flux densities in the preparation of the directly magnetized fluid/gas. In case of permanent magnets setup, up to three-dimensional flux densities can be generated, depending on the distance between the magnetic setup, the geometry of the magnetic setup, and the attraction or repulsion forces between the magnetic setup.
4. Use of any magnetic or electromagnetic setup in the preparation of the directly magnetized fluid/gas. This includes the type of magnets used (NdFeb, or any other magnetic material), the shape of the magnets (rectangular, cylindrical, or any other shape), the number of magnets used, the three-dimensional configuration of the setup, and other related parameters regarding the setup.
5. Use of flux densities ($B_x$, $B_y$, $B_z$) ranging from few gausses to the range of Teslas in the preparation of the directly magnetized fluid/gas.
6. Use of magnetic field whether in the attraction form or in the repulsion form in case of permanent magnets in the preparation of the directly magnetized fluid/gas.
7. A Current control system in case of electromagnetic field setup might be a DC current source or a DC voltage source in series with a variable resistor. In case of using an AC source, then a converter can be used to convert it to DC and then apply one of the two previous scenarios.
8. The temperature, pressure, and volume (level) of the directly magnetized fluid/gas are tuned and controlled during the generation of directly magnetized fluid/gas and the mixing process.
9. The temperature, pressure, and volume (level) of the normal non-magnetized fluid/gas and the mixed or indirectly-magnetized fluid/gas are tuned and controlled during the mixing process and in the storage phases.
10. The heating or cooling element anywhere used in the figures means a heating and/or cooling system that controls the temperature of the fluid/gas exactly as required.
11. During the preparation of the directly magnetized fluid/gas, a flow control system for the working fluid/gas can be used to control the flow rate of the fluid/gas that is moving under the effect of the magnetic field.
12. All of the controlling parameters of the present invention might be controlled according to inline sensors data that can be used in both phases of the treatment (generation of directly magnetized fluid/gas and the mixing process). These sensors are fluid/gas dependent and application dependent. For example in case of fuel treatment, we have used inline viscosity and density sensors to observe the changes in the physical parameters of the fluid/gas. If the working fluid/gas is water, we might use inline PH and TDS sensors or any other sensors.
13. Use of most commonly used modes of operation regarding the angle between the magnetic field and the fluid/gas flow where the angle might be 90, 0, 180 degrees or other angles depending on the source of magnetic field and the shape of the pipe in which the fluid/gas, is flowing
14. The magnetic field in the preparation of the directly magnetized fluid/gas might be generated using permanent magnet setup (for example, but not limited to, the FIGS. 13 to 16) or electromagnetic field where a dc current is passing in a coil (for example, but not limited to, FIG. 12).

15. In case of variable distance permanent magnets setup, an actuation mechanism that controls the distance between the two magnets might be hydraulic, pneumatic, electric actuator or any other possible mechanism.
16. The shape of the pipe in which the fluid/gas is flowing under the effect of the magnetic field which might be straight, vertical-horizontal, helical three-dimensional (spring like) shapes or any other shape as shown in FIG. 17.
17. The fluid/gas flow under the effect of the magnetic field during the preparation of the directly magnetized fluid/gas might be under the effect of gravitational forces in case of vertical flow or might be horizontal flow.
18. Use of circular, square, or rectangular cross sections of the inner core of the pipe under the effect of the magnetic field as shown in FIG. 17.
19. The diameter of the pipe in which the fluid/gas is flowing under the effect of the magnetic field might be in the micro level or the macro level or might take any value from Pico size to centimeters size.
20. The directly magnetized fluid/gas might be generated using one circulation time (one passage in the magnetic field) or might be circulated continuously for certain period of time.
21. The mixing ratio between the directly magnetized fluid/gas and the normal non-magnetized fluid/gas generally depends on the working fluid/gas, the operating temperature and pressure of the working fluid/gas, the flux density in three dimensional spaces, the angle between the fluid/gas flow and the applied flux, the circulation time, and the application.
22. The directly magnetized fluid/gas and the mixed or indirectly-magnetized fluid/gas might be kept at certain pressure and temperature for certain duration during their storage for later use. This process controls the magnetic memory of both fluids/gases.
23. The normal non-magnetized fluid/gas and the directly magnetized fluid/gas have generally the same chemical structure, but in some applications, they might have different chemical structure.
24. Possible applications for the invention might include, but not limited to, all conventional applications of the direct magnetic treatment of fluid/gas such as water treatment for agricultural purposes, water treatment for scaling, water treatment for salinity reduction, water treatment for construction, fuel treatment, diesel treatment, gasoline treatment, kerosene treatment, fuel oil treatment, jet fuel treatment and all other existing magnetic treatment methods.

Application Case

The method and apparatus in accordance with the present invention were applied in the treatment of diesel fuel. In this example, a pair of rectangular NdFeb magnet setup of the size 15*10*6 cm for each magnet was used in the magnetic treatment setup shown in FIGS. 13 to 16. FIG. 18 shows the magnetic flux densities ($B_x$, $B_y$, $B_z$) at the central point across width and length of the magnet as a function of the inner distance between the magnets for the attraction case. FIG. 19 shows the magnetic flux densities ($B_x$, $B_y$, $B_z$) at the central point across width and length of the magnet as a function of the inner distance between the magnets for the repulsion case. For treatment purposes, the magnets were operated in the attraction case and separated by 2 cm distance. First, the diesel was treated for 36 hours and, then, this directly magnetized diesel was mixed with a normal diesel in accordance with various mixing ratios. The results of heat content of the mixed or indirectly-magnetized diesel and the corresponding viscosity and density are given in Table 1. The mixing ratio is by volume and the total sample volume is one liter.

Although the above description of the application case contains many specificities, these should not be construed as limitations on the scope of the invention but is merely representative of the presently preferred embodiments of this invention. The embodiments) of the invention described above is (are) intended to be exemplary only. The scope of the invention is therefore intended to be limited solely by the scope of the appended claims.

TABLE 1

| Sample Name | Mixing Procedure | Heat Content (cal/g) | Dynamic Viscosity | Static Viscosity | Density |
|---|---|---|---|---|---|
| normal non-magnetized diesel | Normal non-magnetized alone | 10504 | 4.4326 | 5.2925 | 0.8375 |
| magnetic treated diesel | Treated alone | 10487 | 3.3581 | 4.0311 | 0.8331 |
| 60% magnetic treated diesel | treated diesel at the top of normal non-magnetized diesel | 10752 | 5.2446 | 6.219 | 0.8433 |
| 50% magnetic treated diesel | treated diesel at the top of normal non-magnetized diesel | 10777 | 5.2044 | 6.1702 | 0.8435 |
| 40% magnetic treated diesel | treated diesel at the top of normal non-magnetized diesel | 10802 | 5.1473 | 6.1042 | 0.8432 |
| 30% magnetic treated diesel | treated diesel at the top of normal non-magnetized diesel | 10827 | 5.0594 | 6.002 | 0.843 |
| 2% magnetic treated diesel | treated diesel at the top of normal non-magnetized diesel | 10852 | 4.7976 | 5.7043 | 0.8411 |
| 1% magnetic treated diesel | treated diesel at the top of normal non-magnetized diesel | 10841 | 4.8053 | 5.7178 | 0.8404 |

TABLE 1-continued

| Sample Name | Mixing Procedure | Heat Content (cal/g) | Dynamic Viscosity | Static Viscosity | Density |
|---|---|---|---|---|---|
| 0.2% magnetic treated diesel | treated diesel at the top of normal non-magnetized diesel | 11123 | 4.7722 | 5.675 | 0.8409 |
| 0.1% magnetic treated diesel | treated diesel at the top of normal non-magnetized diesel | 10810 | 4.7976 | 5.7038 | 0.8411 |
| 0.02% magnetic treated diesel | treated diesel at the top of normal non-magnetized diesel | 10962 | 4.776 | 5.679 | 0.841 |
| 0.01% magnetic treated diesel | treated diesel at the top of normal non-magnetized diesel | 10817 | 4.4498 | 5.3113 | 0.8378 |

The invention claimed is:

1. A method of indirect magnetic treatment of fluids, the method comprising:

a. producing, in a first sub process, a directly magnetized fluid by:

first providing a non-magnetized fluid in a treatment vessel, and second, performing a circulation process of a controlled flow through a magnetic treatment unit that outputs its flow back to the treatment vessel, wherein the non-magnetized fluid in the treatment vessel passes through a direct magnetic or electromagnetic field generated by the magnetic treatment unit during the circulation process; and b. producing, in a second sub process, an indirectly magnetized fluid, by performing a mixing process between the directly magnetized fluid produced from the first sub process, and the non-magnetized fluid according to a mixing ratio and a mixing method, wherein a temperature, a pressure, and a volume of the two sub processes are tuned and controlled during the producing of the directly magnetized fluid and the producing of the indirectly magnetized fluid, wherein the non-magnetized fluid becomes magnetically treated indirectly from the directly magnetized fluid during the production of the indirectly magnetized fluid, such that the indirectly magnetized fluid becomes totally treated without any direct application of the direct magnetic or electromagnetic field to the indirectly magnetized fluid, wherein after the first sub-process is performed, the directly magnetized fluid is stored in the treatment vessel prior to the mixing process, and wherein the direct magnetic or electromagnetic field is never directly applied to the indirectly magnetized fluid.

2. The method of indirect magnetic treatment of fluids as claimed in claim 1, wherein the directly magnetized fluid acts as a magnetizer or a magnetic treating agent for magnetizing the non-magnetized fluid during the production process of the indirectly magnetized fluid using the mixing process.

3. The method of indirect magnetic treatment of fluids as claimed in claim 1, wherein the producing the indirectly magnetized fluid comprises:

first depositing the directly magnetized fluid in a bottom of a mixing vessel; and second depositing the non-magnetized fluid on a top of the directly magnetized fluid, wherein the first depositing and the second depositing are performed once or repeated a plurality of times.

4. The method of indirect magnetic treatment of fluids as claimed in claim 1, wherein the producing the indirectly magnetized fluid comprises:

first depositing the non-magnetized fluid in a bottom of a mixing vessel; and second depositing the directly magnetized fluid on a top of the non-magnetized fluid, wherein the first depositing and the second depositing are performed once or repeated a plurality of times.

5. The method of indirect magnetic treatment of fluids as claimed in claim 1, wherein the producing the indirectly magnetized fluid comprises:

providing a first vessel for receiving the directly magnetized fluid;

providing a second vessel for receiving the non-magnetized fluid; and providing a third vessel for receiving the indirectly magnetized fluid that is in connection with the first vessel and the second vessel for simultaneously receiving a first controlled flow of the directly magnetized fluid and a second controlled flow of the non-magnetized fluid.

6. The method of indirect magnetic treatment of fluids as claimed in claim 1, wherein the producing the indirectly magnetized fluid comprises:

providing an inline magnetic treatment unit for applying the magnetic or electromagnetic field on the non-magnetized fluid to yield the directly magnetized fluid instantaneously; and providing a first vessel for the non-magnetized fluid in connection with the magnetic treatment unit and with a second vessel for the indirectly magnetized fluid, wherein the magnetic treatment unit receives from the first vessel a controlled flow of the non-magnetized fluid and applies the magnetic or electromagnetic field on the non-magnetized fluid, and wherein the second vessel simultaneously receives a first controlled flow of the directly magnetized fluid from the magnetic treatment unit and a second controlled flow of the non-magnetized fluid from the first vessel.

7. The method of indirect magnetic treatment of fluids as claimed in claim 1, wherein the producing the indirectly magnetized fluid comprises:

providing a first vessel for receiving the non-magnetized fluid;

providing a second vessel for receiving the directly magnetized fluid; and providing a third vessel for receiving the indirectly magnetized fluid, wherein the second vessel receives a controlled flow of the non-magnetized fluid from the first vessel and outputs a flow of the indirectly magnetized fluid for the third vessel comprising the directly magnetized fluid and the non-magnetized fluid after being mixed with each other.

8. The method of indirect magnetic treatment of fluids as claimed in claim 1, wherein the directly magnetized fluid and the non-magnetized fluid used in the mixing process are of identical chemical composition.

9. The method of indirect magnetic treatment of fluids as claimed in claim 1, wherein the directly magnetized fluid can be used immediately in the mixing process, or stored for later usage in the mixing process.

10. The method of indirect magnetic treatment of fluids as claimed in claim 1, wherein the indirectly magnetized fluid can be used immediately in an application, or stored for later usage in an application.

* * * * *